US009366441B2

(12) United States Patent
Hayashi et al.

(10) Patent No.: US 9,366,441 B2
(45) Date of Patent: Jun. 14, 2016

(54) BURNER, COMBUSTOR AND REMODELING METHOD FOR BURNER

(75) Inventors: Daisuke Hayashi, Hitachi (JP); Shohei Yoshida, Hitachiohta (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 1520 days.

(21) Appl. No.: 12/706,011

(22) Filed: Feb. 16, 2010

(65) Prior Publication Data

US 2010/0248171 A1 Sep. 30, 2010

(30) Foreign Application Priority Data

Mar. 26, 2009 (JP) ..... 2009-075809

(51) Int. Cl.

| | |
|---|---|
| ***F23D 5/00*** | (2006.01) |
| ***F23R 3/34*** | (2006.01) |
| ***F23D 14/64*** | (2006.01) |
| ***F23R 3/10*** | (2006.01) |
| ***F23R 3/28*** | (2006.01) |

(52) U.S. Cl.

CPC ..... *F23R 3/343* (2013.01); *F23D 14/64* (2013.01); *F23R 3/10* (2013.01); *F23R 3/286* (2013.01); *F23D 2900/00008* (2013.01); *F23R 2900/00002* (2013.01)

(58) Field of Classification Search

CPC ..... F23D 14/64; F23R 3/343

USPC ..... 431/195, 196, 201, 354

See application file for complete search history.

(56) References Cited

U.S. PATENT DOCUMENTS

| | | | | |
|---|---|---|---|---|
| 2003/0148236 | A1 * | 8/2003 | Joshi et al. | 431/9 |
| 2004/0163392 | A1 * | 8/2004 | Nishida et al. | 60/737 |

FOREIGN PATENT DOCUMENTS

| | | | | |
|---|---|---|---|---|
| JP | 2003-148734 | A | | 5/2003 |
| JP | 2006017381 | A | * | 1/2006 |
| JP | 2007033025 | A | * | 2/2007 |

* cited by examiner

*Primary Examiner* — Avinash Savani
*Assistant Examiner* — Aaron Heyamoto
(74) *Attorney, Agent, or Firm* — Mattingly & Malur, PC

(57) ABSTRACT

A combustor with a burner maintains combustion stability. The burner includes an air hole member 31 with a plurality of air holes 34, 35 provided at an upstream side of the combustion gases generated by a combustion chamber 1. A first fueling nozzle 33 jets fuel in a direction crossing a central axis of the burner towards at least two of air holes 35. A plurality of second fueling nozzles 32, one for each of the remaining air holes 34, are provided to jet the fuel in a direction routed along the burner axis towards the corresponding air hole 34. A fuel header 30 distributes the fuel to the first fueling nozzle 33 and each of the second fueling nozzles 32. A fuel header storage unit 70 shrouds the fuel header 30, fueling nozzles 32, 33, and has an air inflow hole 71.

9 Claims, 9 Drawing Sheets

BURNER, COMBUSTOR AND REMODELING METHOD FOR BURNER

BACKGROUND OF THE INVENTION

1. Field of the Invention

The present invention relates to a burner, a combustor, and a method for remodeling the burner which are used for a gas turbine generator.

2. Description of the Related Art

As more attention was focused on energy resource problems and environmental problems, a variety of approaches have been made over long periods of time in various fields. Related techniques concerning gas turbines have also been developed and remarkable advancements have been achieved in lower-NOx combustion as well as in the improvement of combustion efficiency by temperature enhancement of the combustion gases discharged from a combustor. With increasingly tightened regulations relating to NOx emissions, however, there is a urgent need to further reduce NOx emissions.

JP-2003-148734-A, for example, discloses, as part of the above, a gas turbine combustor configured to inject a fuel into air holes, form coaxial jet flows of the fuel and air, and supply the jet flows to a combustion chamber.

SUMMARY OF THE INVENTION

Gas turbine combustors have significantly decreased in NOx emission level by shifting from the diffusion combustion type to the premixed combustion type. However, since it is necessary to operate a gas turbine under the wide range of conditions that spans from starting conditions to rated load conditions, a pilot burner with high combustion stability is disposed centrally in a combustor. The pilot burner of the gas turbine combustor described in JP-2003-148734-A includes two concentric arrays of air holes, and in cases such as this, fuel consumption and the amount of air supplied thereto will greatly differ according to the object to which the burner is applied. In gas turbine combustors, since the supply rate of air and the flow rate of a fuel both increase with increases in power generator output, the entire combustor requires dimensional extension and as a result, the burner also needs to be sized up. Similar extension of the burner, however, increases air hole diameters and is therefore liable to reduce premixing performance because of the resulting increases in the air hole volumes required for fuel-air premixing. To size up such a burner as disclosed in JP-2003-148734-A, therefore, it is effective to increase the number of fueling nozzles and air holes, not to adopt similar extension.

In the burner of JP-2003-148734-A, however, air holes and combustion nozzles are in a quantitative relationship of 1:1. For example, if a burner with 18 fueling nozzles is used as a pilot burner, and six more burner cans of the same type as that of the pilot burner are arranged around it, 126 fueling nozzles will be required for one combustor can. In this case, if 10 combustor cans are arranged in the gas turbine, the number of fueling nozzles required will exceed 1,200 and the resulting significant increase in the number of parts required is likely to present problems associated with fabrication and maintenance.

The present invention has been made with the above circumstances in mind, and an object of the invention is to provide: a combustor with a burner adapted to maintain combustion stability while suppressing a quantitative increase of fueling nozzles due to enlarging; and a remodeling method for the burner.

In order to achieve the above object, a burner of the present invention comprises: an air hole member with a plurality of air holes, each of which is provided at an upstream side of combustion gases generated by a combustion chamber; a first fueling nozzle for jetting a fuel in a direction crossing a central axis of the burner, towards at least two of the plurality of air holes; a plurality of second fueling nozzles each provided in association with one of the remaining air holes and formed for jetting the fuel in a direction routed along the burner axis, towards the associated air hole; a fuel header for distributing the fuel to the first fueling nozzle and each of the second fueling nozzles; and a fuel header storage unit that shrouds the fuel header, the first fueling nozzle, and each second fueling nozzle, and having an air inflow hole.

According to the present invention, combustion stability can be maintained while suppressing a quantitative increase of fueling nozzles, associated with enlarging of the fueling nozzles.

DESCRIPTION OF THE PREFERRED EMBODIMENTS

Hereunder, embodiments of the present invention will be described with reference to the accompanying drawings.

A burner according to the present embodiment includes: an air hole member with a plurality of air holes; a first fueling nozzle for jetting a fuel towards at least two of the air holes; a plurality of second fueling nozzles each for jetting the fuel towards one of the corresponding air holes; a fuel header for distributing the fuel to the first fueling nozzle and each of the second fueling nozzles; and a fuel header storage unit that shrouds the fuel header, the first fueling nozzle, and each second fueling nozzle, and having an air inflow hole. The air hole member is provided at an upstream side of combustion gases generated by a combustion chamber, with the air holes in the air hole member being inclined in a circumferential direction with respect to a central axis of the burner. The first fueling nozzle jets the fuel in a direction crossing the burner axis towards at least two of the air holes at the same time. The second fueling nozzle provided for each of the remaining air holes jets the fuel in a direction routed along the burner axis towards the corresponding air hole.

The number of fueling nozzles required can be minimized because of jetting the fuel from the first fueling nozzle towards at least two air holes in this manner. In addition, in order to enable the first fueling nozzle to jet the fuel towards at least two air holes, the first fueling nozzle is disposed at an offset position with respect to a central portion of an entrance of each corresponding air hole, so that the entrance of the corresponding air hole is kept clear of an obstruction (fueling nozzle) and thus kept widely open. This suppresses a disturbance in a flow of air into the air holes corresponding to the first fueling nozzle, and hence suppresses mixing of the fuel and the air in the air holes. The suppression of fuel-air mixing, in turn, forms diffusively combusting flames in downstream regions of the air holes corresponding to the first fueling nozzle, and ensures stable combustion characteristics under a wide range of operating conditions. In addition, after the fuel has been fully premixed with the air in corresponding air holes, each second fueling nozzle around the first fueling nozzle jets the premixed fuel towards the combustion chamber, so that a premixed combustion region occupies a large portion of a combustion region within the combustion chamber and so that NOx emissions are also suppressed. Combustion stability can therefore be maintained while suppressing an increase in the number of fueling nozzles, associated with enlarging of the fueling nozzles.

Next, more specific examples of the present invention will be described in order.

First Embodiment

Figure 1A:
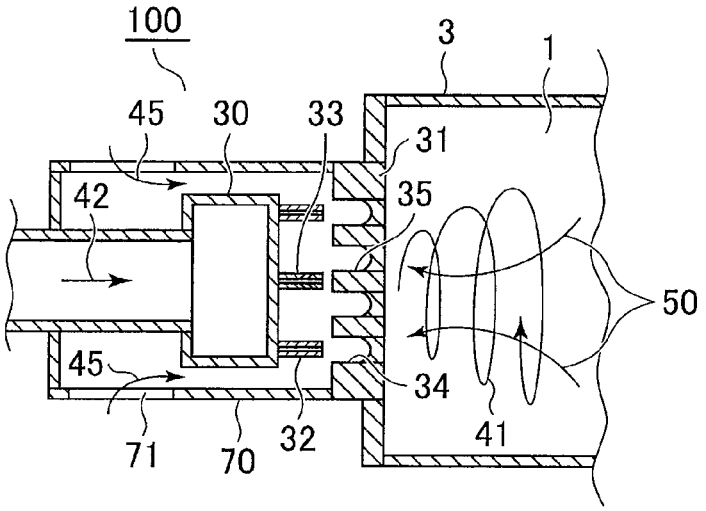
FIGS. 1A to 1C are schematic structural views of burner according to a first embodiment of the present invention.
Figure 1B:
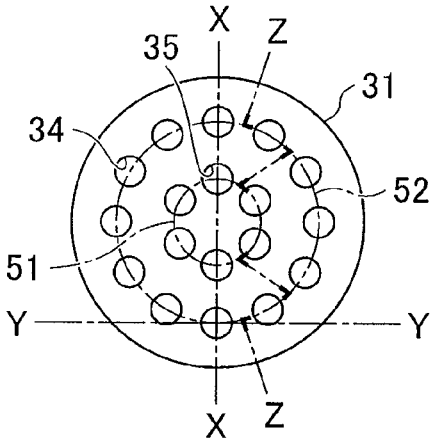
Figure 1C:
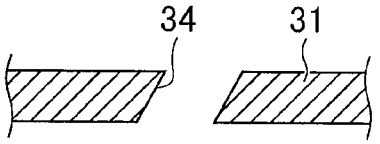

FIGS. 1A to 1C are schematic structural views of a burner according to a first embodiment, FIG. 1A being a lateral sectional view of the burner, FIG. 1B being a front view of the burner existing when an air hole member 31 is viewed from a combustion chamber 1, and FIG. 1C being a sectional view of the burner, taken along line Y-Y in FIG. 1B. FIG. 1A is equivalent to a sectional view taken along line X-X in FIG. 1B.

The burner 100 according to the present embodiment includes: the air hole member 31 inclusive of an air hole array 51 formed by a plurality of annularly arrayed air holes 35, and of an air hole array 52 formed by a plurality of air holes 34 concentrically arrayed at an outer-surface side of the air hole array 51; fueling nozzles 32 and 33 for jetting a fuel (in the present embodiment, a gaseous fuel) towards the air holes 34 and 35, respectively; a fuel header 30 for distributing the fuel to the fueling nozzles 32 and 33; and a fuel header storage unit 70 of a cylindrical shape, adapted for storage of the fuel header 30 and each fueling nozzle 32, 33, and having an air inflow hole 71 at an upstream side thereof relative to the fuel header 30.

The air hole member 31 is disposed on an upstream-side wall surface of the combustion chamber 1. A central axis of an air flow channel in each air hole 34 and 35 is inclined towards one circumferential direction with respect to a central axis of the burner 100. FIG. 1C that is the sectional view taken along line Y-Y in FIG. 1B shows the circumferentially inclined air hole 34. The same also applies to the air hole 35. Each of the air hole 34 and 35 has no radial inclination, so in the lateral view of FIG. 1A that is the sectional view taken along line X-X in FIG. 1B, the air hole looks as if it extends in an axial direction of the burner.

Hereinafter, an opening of each air hole 34 and 35 on a face (left face in FIG. 1A) of the air hole member 31 that is oriented towards a side opposite to the combustion chamber 1 is defined as an entrance of the air hole 34, 35, and an axis extending centrally through the entrance of the air hole and formed perpendicularly to the air hole member 31 (i.e., an axis extending along the burner axis) is defined as a "central axis of the air hole entrance". In addition, since the air hole member 31 in the present embodiment has a disc shape, a central point of the air hole member 31 is defined as the burner surface center.

The fueling nozzles 32 and 33 differ in fuel-jetting form with each other. The fueling nozzle 32 for jetting the fuel towards the air hole 34 positioned at the outer-array jets the fuel from a distal end of the nozzle, towards the burner axis direction, and the fueling nozzle 33 for jetting the fuel towards the air hole 35 positioned at an inner-array jets the fuel from a plurality of jetting ports, in a radially outward inclined direction relative to the direction of the burner axis.

The fueling nozzle 32 forms a pair with the corresponding air hole 34, and one fueling nozzle 33 forms a pair with at least two air holes 35. In the combination of the fueling nozzle 32 and the air hole 34, a central axis of the fueling nozzle 32 is essentially in agreement with the central axis of the entrance of each air hole 34. In the combination of the fueling nozzle 33 and the air holes 35, the central axis of the fueling nozzle 33 is essentially in agreement with the burner central axis (equivalent to the central axis of the air hole member 31).

Air 45 that has flown into the air inflow hole 71 of the fuel header storage unit 70 is jetted into the combustion chamber 1 through the air holes 34 and 35 and forms a rotational flow 41 in a downstream region of the burner 100. Also, fuel 42 that has flown into the fuel header 30 is distributed to the plurality of fueling nozzles 32 and 33. The jet flow of the fuel that has been jetted from each fueling nozzle 32 and 33 passes through the air holes 34 and 35 respectively, and flows with the air into the combustion chamber 1. Since a circulation flow 50 occurs centrally in the rotational flow 41 and a low-velocity region is created, flames can be retained with the low-velocity region as its starting point. The rotational flow 41 reduces NOx emissions.

Figure 2:
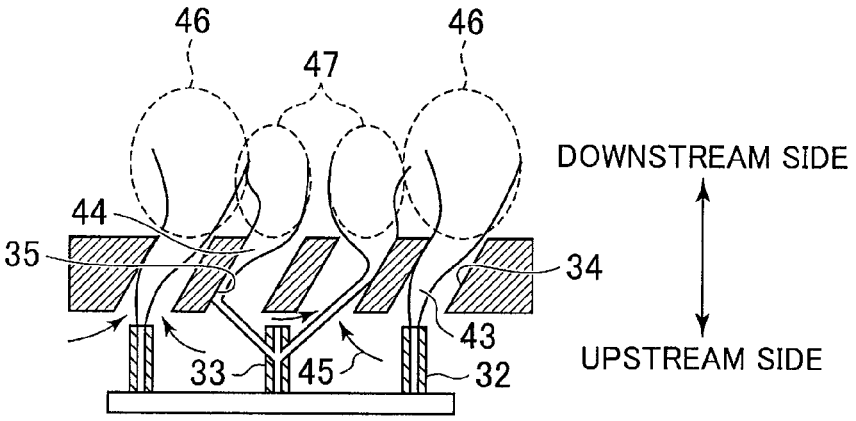
FIG. 2 is a sectional view of the burner, taken along line Z-Z in FIG. 1B.

FIG. 2 is a sectional view of the burner, taken along line Z-Z in FIG. 1B, and represents the air holes of the inner air hole array 51 and outer air hole array 52 together with the corresponding fueling nozzles 32, 33, in a circumferentially developed form.

As shown in FIG. 2, the distal end of the fueling nozzle 32 is opposed to the entrance of the air hole 34 and positioned upstream (at the side opposite to the combustion chamber 1) with respect to an air hole entrance face of the air hole member 31. Because of this, a space between the fueling nozzle 32 and the air hole 34 is narrower than that between the fueling nozzle 33 and the air holes 35, and the fuel jet flow 43 that has jetted from the fueling nozzle 32 and flown into the air hole 34 further flows while being surrounded in the air hole 34 by a turbulent flow of the air 45 which has flown into the air hole 34. Accordingly, the fuel jet flow 43 and the air 45 are jetted into the combustion chamber 1 while being mixed. By the time the fuel-air mixture is thus jetted from the air hole 34 into the combustion chamber 1, the mixing of the fuel jet flow 43 and the air 45 has already progressed, so the flame formed in a downstream region 46 of the air hole 34 will be a premixed flame and thus, NOx emissions will be suppressed.

Meanwhile, the fueling nozzle 33 has its distal end opposed nearly to a central point of the disc-shaped air hole member 31 and positioned upstream (at the side opposite to the combustion chamber 1) with respect to the air hole entrance face of the air hole member 31. Thus, a fuel jet flow 44 divergently jets from a plurality of injection ports provided on an outer surface of the fueling nozzle 33, and after colliding against an inner wall surface of the air hole 35, flows towards the downstream side, along the inner wall surface. The fueling nozzle 33 is offset from the entrance center of the air hole 35, and an opposed region of the air hole 35 is more widely open than that of the air hole 34. Therefore, although the amount of air flowing into the air hole 35 increases relatively in comparison with the case of the combination of the fueling nozzle 32 and the air hole 34, but since a disturbance does not easily occur in the air hole 34, the fuel jet flow 44 is jetted into the combustion chamber 1 without being mixed with the air 45 too much. In other words, since the fueling nozzle 33 is not opposed to the entrance of the air hole 35, an obstruction that disturbs the flow of the air 45 is absent and thus the mixing of the fuel jet flow 44 and the air 45 is suppressed.

The schematic view of FIG. 2 represents a state in which the fuel jet flow 44 is in collision against an inclined face of the air hole 35. During actual operation, however, the fuel jet flow 44 collides against the face of the air hole 35 that extends in the axial direction of the burner, because the fuel jet flow 44 is jetted radially from a central position of the burner and because the air hole 35 inclines in a circumferential direction of the burner.

In this case, when an inclination angle or inclining direction of the air hole 35 is changed from the form shown in FIG. 2, adjustments are desirably conducted in a range such that the fuel jet flow 44 jetted from the fueling nozzle 33 will collide against at least the inner wall surface of the air hole 35. In addition, the air hole member 31 requires moderate thickness considering that the fuel jet flow 44 jetted from the fueling nozzle 33 will collide against the inner wall surface of the air hole 35. For example, if a central axis of an air flow channel of the air hole 35 and a central axis of the fuel jet flow 44 approach parallelism, the air hole member 31 may need to be thicker, and if the central axis of the air flow channel of the air hole 35 and the central axis of the fuel jet flow 44 approach perpendicularity, the air hole member 31 may need only to be thinner.

For the above reasons, the fuel jet flow 44 jetted from the fueling nozzle 33 jets into the combustion chamber 1 almost without mixing with the air 45 during passage through the air hole 35, and a diffusively combusting flame is formed in a downstream region 47 of the air hole 35. Thus, very stable combustion characteristics can be ensured and the flames stabilized under a wide range of operating conditions can be maintained.

For these reasons, since the pair of the fueling nozzle 33 and at least two air holes 35 in the inner air hole array 51 of the air hole member 31, and the pair of the fueling nozzle 32 and one air hole 34 in the outer air hole array 52 are parallely arranged to each other as shown in FIGS. 1B and 2, combustion flames are formed so that as shown in FIG. 2, the premixedly combusting flames in downstream regions 46 surround the diffusively combusting flames in downstream regions 47 of the air hole member 31. High stability of the regions in which the flames diffusively combusts allows continued stable combustion under the wide range of conditions. The air holes 35 in the inner air hole array 51 have an inclination angle with respect to the central axis of the burner, so the fuel jet flow 44 jetted from each air hole 35, and the air 45 are spirally blown out into the combustion chamber 1. Accordingly, the premixture jetting from the air hole 34 in the air hole array 52 combusts in that premixed form while being supplied with heat and a chemical revitalization material from the diffusively combusting flames formed centrally in the burner, and the combustion of the premixture is stable, even under low combustion temperature conditions. That is to say, NOx emissions can be controlled to a low level since very stable flames are formed in the downstream direction relative to the diffusive combustion regions formed in the downstream regions 47 of the air holes 35, and since the premixed combustion regions predominate each entire flame.

Also, forming a diffusive combustion region of a rotational flow by inclining the air hole 35 with respect to the central axis of the burner strengthens the combustion stability of the entire flame, thus allowing an under-load operating range of the gas turbine to be extended. Further, flame stability can also be obtained, even if a low-reactivity fuel heavily laden with nitrogen is used. In addition, even though only the air holes 35 in the inner air hole array 51 are inclined, a sufficient amount of heat and a chemical revitalization material can be supplied to a surrounding region of the burner, such that the burner can sufficiently function as a pilot burner. What requires precaution is that the fuel jet flow 44 from the fueling nozzle 33 collides with the inner wall surface of each inclined air hole 35.

As shown in FIGS. 1A and 2, the fueling nozzle 32 is not tapered at its distal end and has a cylindrical shape. For the fueling nozzle 33, although its outer circumferential surface needs to have a plurality of fuel-jetting ports, a distal-end shape of the nozzle is not limited to the form shown in the figures. Omission of tapering leads to a decrease in the number of manufacturing man-hours required, and hence minimizes manufacturing costs. If the distal end of the fueling nozzle 32 is tapered, this reduces a magnitude of the disturbance occurring in the flow of air into the air hole 34, and allows the distal end of the fueling nozzle 32 to be brought closer to the entrance of the air hole 34 than that shown in FIG. 2. Additionally, the flow channel of the air flowing into the air hole 34 can then maintain a sufficient area and provide large enough an amount of air.

It is possible that a fuel jet flow guide extending towards the air hole 35 will be installed at each fuel-jetting port of the fueling nozzle 33. The installation of the guide is estimated to cause a disturbance or fluid whirlpool in the flow of the air, accelerate the mixing of the fuel jet flow 44 and the air 45, and slightly change the combustion characteristics from diffusive combustion to premixed combustion. In this case, it is considered that although combustion stability will decrease, NOx emissions will also decrease.

It can be seen from the above that the number of fueling nozzles required can be minimized because of jetting the fuel from the fueling nozzle 33 towards at least two air holes 35. In addition, since the fueling nozzle 33 is disposed at a position offset from the center of the entrance of the air hole 35 in order to enable the nozzle 33 to jet the fuel into each air hole 35, the entrance of the air hole 35 is kept clear of an obstruction (fueling nozzle) and thus kept widely open. This suppresses a disturbance in the flow of the air 45 into the air hole 35, and hence, the mixing of the fuel and air in the air hole 35. This, in turn, forms a diffusively combusting flame in a downstream region 47 of the air hole 35, ensuring stable combustion characteristics under a wide range of operating conditions. Additionally, since the fueling nozzles 32 around of the fueling nozzle 33 jet into the combustion chamber 1 the fuel that has been sufficiently premixed with air in the air holes 34, each entire flame is predominated by a premixed combustion region and NOx emissions are also suppressed. Combustion stability can therefore be maintained while suppressing an increase in the number of fueling nozzles, associated with enlarging of the fueling nozzles. That is to say, a burner capable of maintaining combustion stability and a low NOx emission level, even with a reduced number of fueling nozzles, can be supplied when the number of fueling nozzles 32 to be used and positions thereof are appropriately selected according to particular operating conditions of the gas turbine.

Second Embodiment

The present embodiment is that in which a burner according to the present invention is applied as a pilot burner for a combustor. A premixed-type gas turbine combustor is described and shown as the present embodiment.

Figure 3:
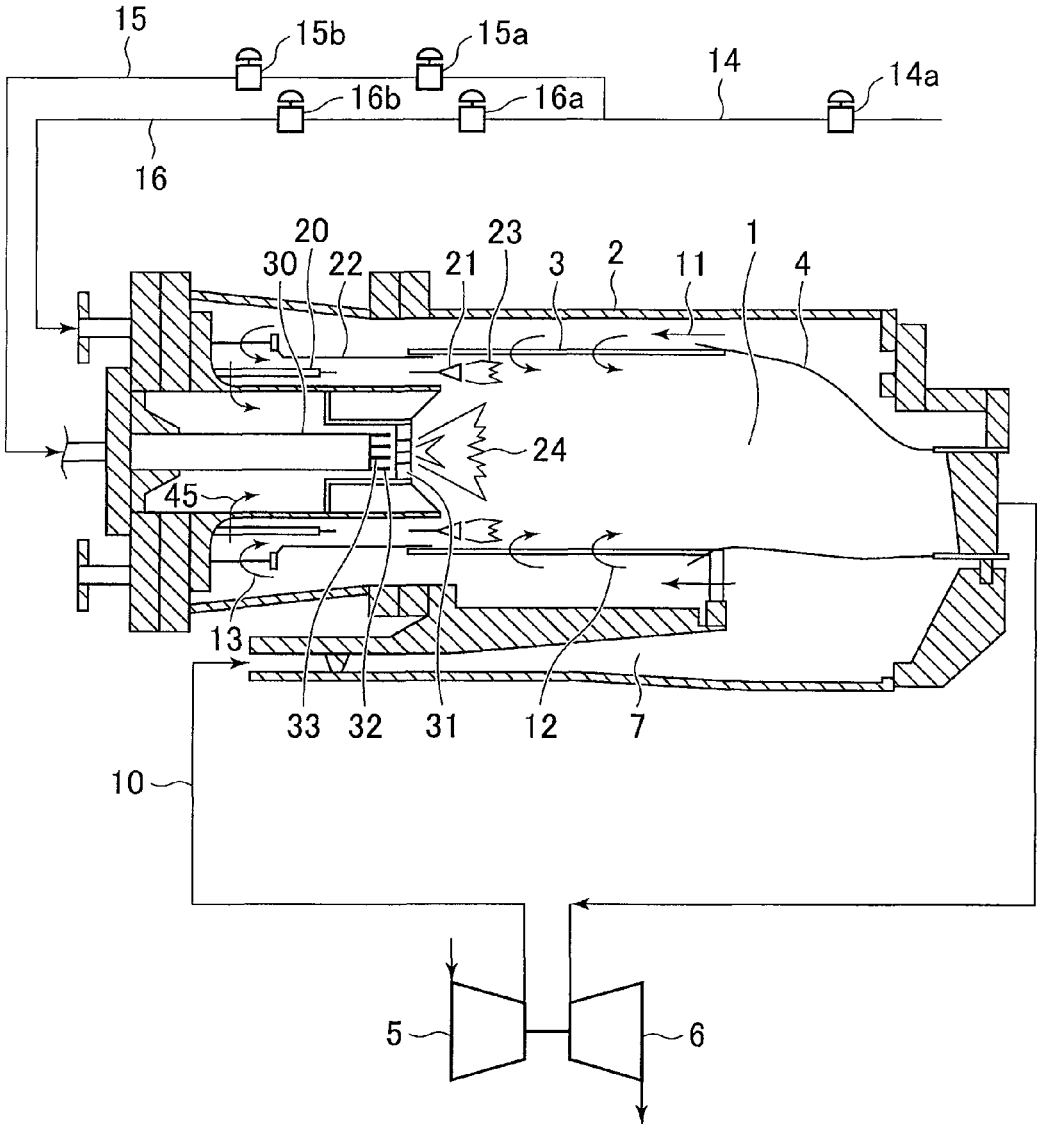
FIG. 3 is a schematic structural view of an entire gas turbine according to a second embodiment of the present invention.
Figure 4:
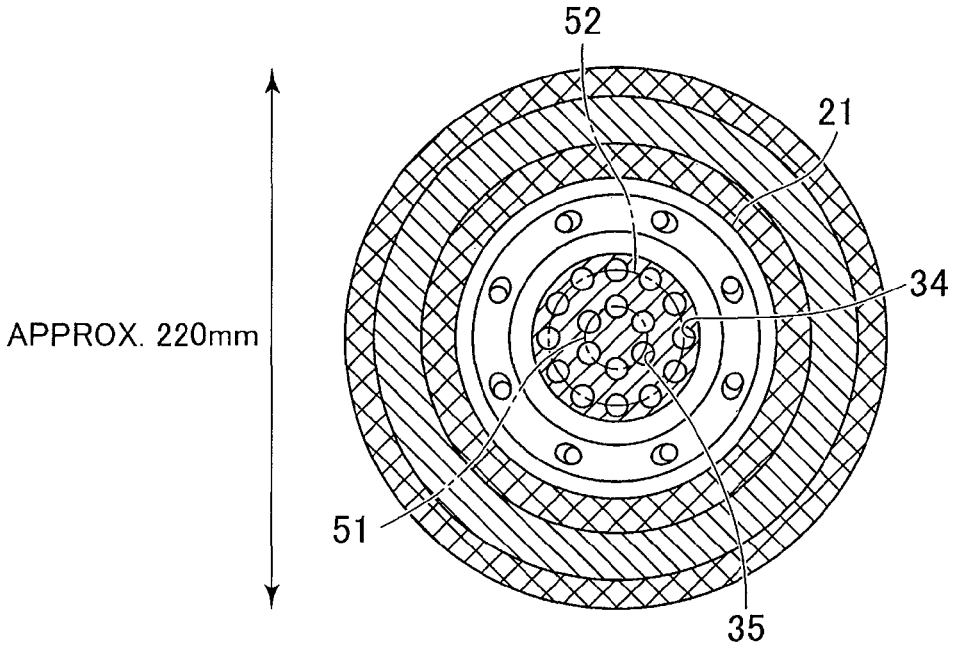
FIG. 4 is a combustor sectional view taken from a combustion chamber side of the combustor equipped in the gas turbine of FIG. 3.

FIG. 3 is a schematic structural view of an entire gas turbine according to the second embodiment of the present invention. FIG. 4 is a combustor sectional view taken from a combustion chamber side of the combustor equipped in the gas turbine of FIG. 3.

During operation of an air supply system, compressed air 10 from a compressor 5 flows from a diffuser 7 into the combustor and then passes through between an outer casing 2 and a combustor liner 3. Part of the air 11 flows into the combustion chamber 1 as cooling air 12 for the combustor liner 3. Remaining portions of the air 11 pass through a premixing channel 22 and an air hole member 31 as combustion airflows 13 and 45, respectively, and flow into the combustion chamber 1. The air is mixed and combusted with a fuel in the combustion chamber 1 in which combustion gases are then generated. The combustion gases are discharged from the combustor liner 3 and supplied to the turbine 6.

In a fuel supply system, the fuel supply system 14 with a control valve 14*a* is branched into fuel supply lines 15 and 16 having control valves 16*a* and 16*b*, respectively. The control valves 15*a* and 16*a* are controllable independently of each other. Cutoff valves 15*b* and 16*b* are arranged downstream with respect to the control valves 15*a* and 16*a*, respectively. The fuel supply line 15 is connected to a fuel header 30 that supplies the fuel to the pilot burner, and the fuel supply line 16 is connected to a fueling nozzle 20 of a premixing burner.

In the present embodiment, the burner of the present invention is set up as the pilot burner in a central section of the combustor, and surrounded by the annular premixing burner. The pilot burner and premixing burner as viewed from the combustion chamber 1 have diameters nearly of 220 mm, for example. The burner in the center, as with that of the first embodiment, includes a fuel header 30, a plurality of fueling nozzles 32 and 33 each connected to the fuel header 30, and an air hole member 31 with a plurality of air holes 34 and 35. The air hole member 31 is positioned on an upstream-side wall surface of the combustion chamber 1. The air holes are concentrically disposed in two arrays, the air holes 35 being disposed in the inner air hole array 51. The air hole 34 is paired with the fueling nozzle 32 having a distal end positioned upstream with respect to an entrance of the air hole 34. The air holes 35 are paired with the fueling nozzle 33 having a distal end positioned upstream with respect to entrances of the air holes 35.

The premixing burner disposed in an outer peripheral portion of the combustor, includes fueling nozzles 20, a premixing channel 22, and flame stabilizers 21 arranged at an exit of the burner. In this premixing burner, a fuel that has been jetted from the fueling nozzle 20 is mixed with combustion air 13 in the premixing channel 22, and then jetted towards the combustion chamber 1 in the form of premixed combustion air. Since the flame stabilizers 21 each for bifurcating a flow pathway of each premixing channel 22 in a radial direction are arranged at the burner exit, a circulation flow 23 is formed at an immediate downstream position relative to the flame stabilizer 21, thereby to hold a flame.

Figure 5:
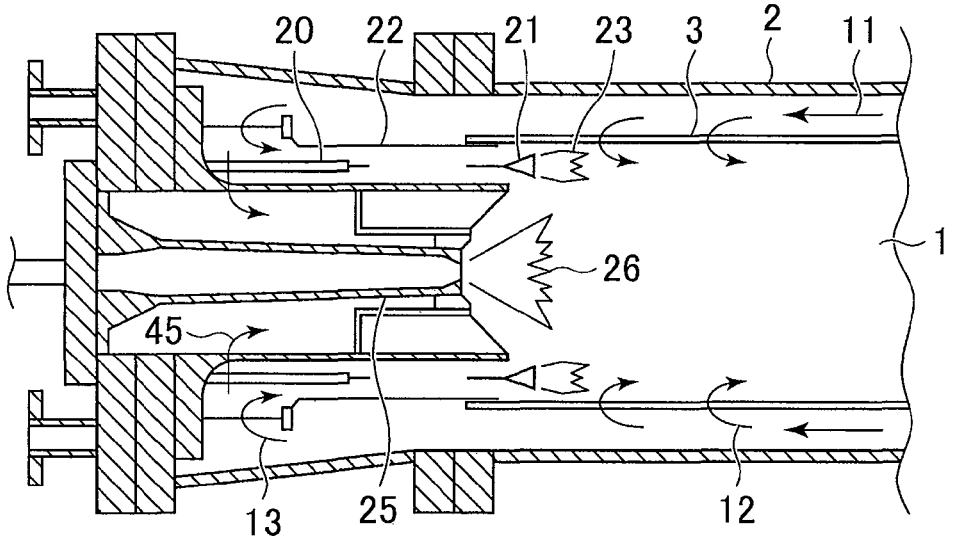
FIG. 5 is a schematic structural view, shown for comparison as a structural example, of a premixed-type gas turbine combustor with a pilot burner different from that of FIG. 3.

A premixed-type gas turbine combustor using a pilot burner different from that of FIG. 3 is shown as a comparative example in FIG. 5.

In the premixed-type gas turbine combustor as the comparative example in FIG. 5, a diffusion burner 25 disposed as a pilot burner centrally in the combustor forms a diffusive flame 26 in the combustion chamber 1. The diffusive flame 26 emanates heat and a chemical revitalization material, and transfer thereof to an outer peripheral portion aids stable combustion of a flame formed downstream with respect to the flame stabilizer 21. In order for a function of the pilot burner to be maintained, however, a flame formed by the pilot burner needs to have a definite size. For this reason, diffusive combustion occupies a definite ratio in the entire combustor and reduction in the NOx emissions in the entire combustor is limited.

The gas turbine of the present embodiment shown in FIG. 3 includes the pilot burner of the present invention, so a flame 24 formed downstream with respect to the burner becomes a premixed flame stabilized with a limited diffusive combustion region as its starting point. Accordingly, the combustor in the present embodiment can reduce NOx emissions significantly, compared with the premixed-type gas turbine combustor using the diffusion burner as the pilot burner.

In addition, since each air hole 34 and 35 in the air hole member 31 has a rotation angle with respect to a central axis of the burner, the flame jetted from the pilot burner becomes a stable flame of a rotational flow. Heat and a chemical revitalization material can therefore be stably supplied to the circulation flow 23 jetted from the premixing burner, and thus the flame by the premixing burner can be stably retained.

As described above, in comparison with the premixed-type gas turbine combustor of FIG. 5 that employs a diffusion burner as the pilot burner, the gas turbine combustor in the present embodiment can be operated under a wide range of operating conditions similarly to the diffusion burner, without significantly deteriorating combustion stability, and can also reduce NOx emissions.

Third Embodiment

In recent years, with the problem of energy resources being exhausted, gas turbines have been required to be versatile for a wider range of fuels. For a fuel with a greater hydrogen content, gas turbines increase in combustion rate, whereas, for a fuel with a greater nitrogen content, they decrease in flame temperature and in combustion rate. In this way, combustion characteristics significantly change with the composition of the fuel, so the arrangement, number, etc. of air holes need to be made appropriate for the fuel composition. In addition, a maximum permissible NOx emission level, an applicable operating range, and the like differ according to a particular usage area of the gas turbine, and these differences require flexible response. In the present invention, NOx emissions and combustion stability can be controlled by changing a layout variation in the combinations between the fueling nozzle 32 and the air hole 34 and between the fueling nozzle 33 and the air holes 35, from the configuration of the first embodiment.

Figure 6:
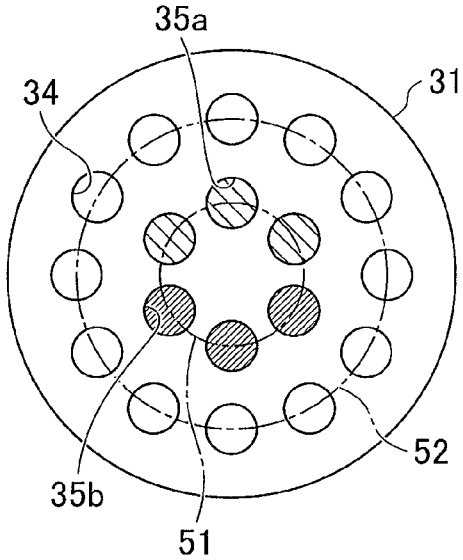
FIG. 6 is a front view, taken from a combustion chamber, of an air hole member formed in a burner equipped in a third embodiment of the present invention.

FIG. 6 is a front view, taken from a combustion chamber, of an air hole member formed in a burner equipped in the third embodiment of the present invention, this front view being keyed to FIG. 1B of the first embodiment.

In the present embodiment, all air holes 34 and 35 arranged concentrically in two arrays have a rotation angle, and six air holes 35 arranged in the inner air hole array 51 are divided into two groups, 35*a* and 35*b*, each having three holes. The air holes 35 of the group 35*a* in FIG. 6 are shown by hatching, and the air holes 35 of the group 35*b*, by masking. The three air holes 35 of the group 35*a* are arranged next to one another on one circumference, and the three air holes 35 of the group 35*b* are likewise arranged next to one another on one circumference. Two first fueling nozzles 33 (see FIG. 2) jet a fuel towards the air holes 35 of the groups 35*a* and 35*b*, respectively. In the first embodiment, one fueling nozzle 33 has jetted a fuel towards six air holes 35, but in the present embodiment, one fueling nozzle 33 jets a fuel towards three air holes 35. Although not shown, the two fueling nozzles 33 are each arranged at a middle position among the three air holes 35 of each group 35*a* and 35*b*, and each nozzle 33 has three fuel-jetting ports on its circumferential surface so as to jet the fuel from that position, towards each air hole 35. Other configurational factors are substantially the same as in the first embodiment.

In the present embodiment, the number of air holes 35 for supplying a fuel from one fueling nozzle 33 is reduced and the fuel jet flow from each air hole 35 into the combustion chamber 1 correspondingly increases in fuel concentration, compared with that of the first embodiment. In this case, premixed regions do not change from those of the first embodiment and the fuel concentration of the jet flow from the air hole 35 increases, which in turn is likely to increase the NOx emissions from the entire combustor. At the same time, however, the diffusive combustion occupying the entire flame will be strengthened and combustion stability in a base of the flame is likely to improve. In addition, there is an advantage of flame stability being easily maintainable, even if the fuel is such a low-calorie fuel or slow-combustion fuel as heavily laden with nitrogen.

Fourth Embodiment

Figure 7:
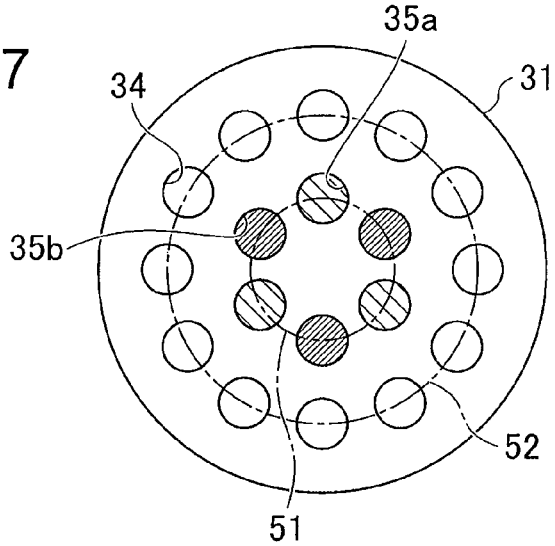
FIG. 7 is a front view, taken from a combustion chamber, of an air hole member formed in a burner equipped in a fourth embodiment of the present invention.

FIG. 7 is a front view, taken from a combustion chamber, of an air hole member formed in a burner equipped in a fourth embodiment of the present invention, this front view being keyed to FIG. 6 of the third embodiment.

In the present embodiment, similarly to the third embodiment, six air holes 35 in an inner air hole array 51 are divided into two groups, 35*a* and 35*b*, each having three holes. However, the three air holes 35 of each group 35*a* and 35*b* are not arranged next to one another, as in the third embodiment, and the air holes 35 of the groups 35*a* and 35*b* are arranged at alternate positions on one circumference. Other configurational factors are substantially the same as in the third embodiment.

In the present embodiment, as with the third embodiment, since the fuel concentration of the fuel jet flow from each air hole 35 increases, an increase in the NOx emissions from the entire combustor is likely to occur, compared with that of the first embodiment. At the same time, however, the diffusive combustion occupying the entire flame will be strengthened in comparison with that of the first embodiment, and combustion stability in the flame base is therefore likely to improve. Additionally in the present embodiment, since each air hole 35 of the group 35*a* and 35*b* is disposed at equal angle intervals of 120 degrees, combustion stability in the entire combustor can be maintained, even if the fuel jet flow from either one of the two groups 35*a* and 35*b* including the air holes 35 is stopped for fuel control or NOx emissions control according to the particular fuel composition, operating range, or the like. For this reason, flame stability can be easily maintained, even when a low-calorie fuel or a fuel of a low combustion rate is used or the operating range is extended.

Fifth Embodiment

Figure 8:
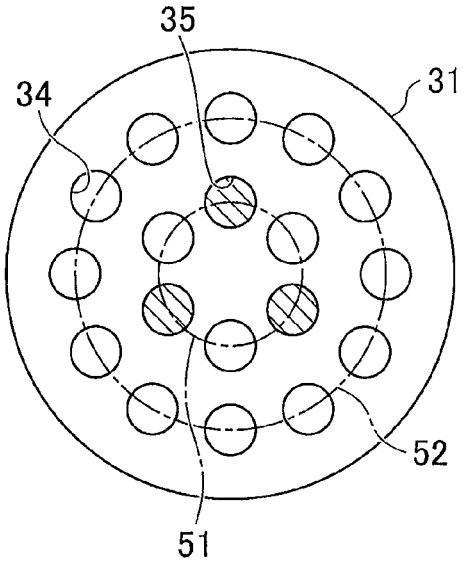
FIG. 8 is a front view, taken from a combustion chamber, of an air hole member formed in a burner equipped in a fifth embodiment of the present invention.

FIG. 8 is a front view, taken from a combustion chamber, of an air hole member formed in a burner equipped in a fifth embodiment of the present invention, this front view being keyed to FIG. 7 of the fourth embodiment.

In the present embodiment, six air holes 34 and 35, each having three holes, are arranged in an inner air hole array 51. The air holes 34 and 35 are arranged at alternate positions in the air hole array 51. Each air hole 35 is therefore disposed at 120-degree angle intervals. A fuel is supplied from one fueling nozzle 33 (see FIG. 2) to the three air holes 35, and the fuel is supplied from a fueling nozzle 32 installed for one air hole 34 to each of the three air holes 34 in the air hole array 51 likewise the combination between an air hole 34 in an outer air hole array 52 and a fueling nozzle 32. The air holes 35 in the present embodiment are arranged at 120-degree angle intervals. Of all six air holes in the air hole array 51, however, any three ones next to one another, for example, may be useable as air holes 35, with all remaining ones being useable as air holes 34, or a manner of arranging each air hole 35 can be freely changed. Other configurational factors are substantially the same as in the first embodiment.

In the present embodiment, since air holes 34 also exist in mixed form in the inner air hole array 51, a rate of premixed combustion increases, which, in turn, correspondingly reduces NOx emissions in comparison with a reduction rate achievable in the first embodiment. Conversely, a decrease in a rate of diffusive combustion due to the decrease in the number of air holes 35 is likely to reduce combustion stability, compared that of the first embodiment, but because of all air holes 34 and 35 being provided with a rotation angle, flames can maintain a stable combustion state while being supplied with heat and a chemical revitalization material from a diffusive combustion region formed centrally in the burner.

Sixth Embodiment

A configuration with a rotation angle assigned only to air holes in an inner air hole array 51 and not assigned to those of an outer air hole array 52 is possible as a variant of the first embodiment. In this variant, machining costs can be reduced since the air holes 34 in the air hole array 52 can be formed by drilling an air hole member 31 vertically. In addition, although a rotational flow formed at a downstream side of the burner will be dimensionally smaller, this will present no problem, provided that the burner is used independently. Furthermore, even when the burner is used as a pilot burner, if its distance from surrounding burners is short enough, a flame formed by that burner will supply sufficient deals of heat and chemical revitalization material to the surrounding burners so as to enable the burner to sufficiently function as the pilot burner. A configuration with a flow channel formed vertically to the air hole member 31 without providing a rotation angle to the air holes in the outer air hole array 52 is effectively applicable to other examples including those described hereinafter.

A configuration with a rotation angle assigned only to air holes in an outer air hole array 52 and not assigned to those of an inner air hole array 51 is also possible as another variant of the first embodiment. In this variant, machining costs can be reduced and even when a rotational flow formed at a downstream side of the burner dimensionally decreases, the burner can be used independently. In addition, even when the burner is used as a pilot burner, if its distance from surrounding burners is short enough, sufficient deals of heat and chemical revitalization material can be supplied to a flame region formed by the surrounding burners so as to enable the burner to sufficiently function as the pilot burner.

It is further conceivable that the air hole member 31 will have all its air holes formed in an axial direction of the burner (i.e., vertically to the air hole member 31). Although machining costs can be further reduced in this case, forming such an air hole member is likely to be unfavorable in terms of supply of heat and a chemical revitalization material and in perspective of combustion stability.

Seventh Embodiment

Figure 9:
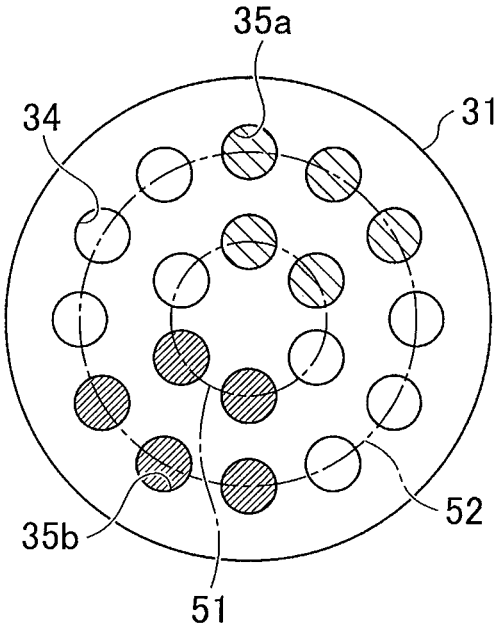
FIG. 9 is a front view, taken from a combustion chamber, of an air hole member formed in a burner equipped in a seventh embodiment of the present invention.

FIG. 9 is a front view, taken from a combustion chamber, of an air hole member formed in a burner equipped in a seventh embodiment of the present invention, this front view being keyed to FIG. 1B of the first embodiment.

In the present embodiment, all air holes 34 and 35 are provided with a rotation angle for circumferential inclination to a central axis of the burner, and the air holes 34 and 35 are present in both an inner air hole array 51 and an outer air hole array 52. As with the first or third embodiments, each air holes 34 is paired with an independent fueling nozzle 32, and the air holes 35 are paired with a fueling nozzle 33. Also, the air holes 35 are divided into two groups, 35*a* and 35*b*. The group 35*a* includes five air holes in which two holes are in the air hole array 51 and three holes are in the air hole array 52. The five air holes 35 in the group 35*a* are aggregated in one fan-shaped region, and a fuel is supplied from the same fueling nozzle 33 to each air hole 35. The group 35*b* also includes five air holes in which two holes are in the air hole array 51 and three holes are in the air hole array 52. The five air holes 35 in the group 35*b* are aggregated in one fan-shaped region which is 180 degrees opposed to the group 35*a*, and the fuel is likewise supplied from the same fueling nozzle 33 to each air hole 35. In both air hole arrays 51 and 52, regions between the groups 35*a* and 35*b* are occupied by air holes 34 each of which is supplied with the fuel from the corresponding fueling nozzle. The air holes 34 are constituted by a total of eight air holes including two holes in the air hole array 51 and six holes in the air hole array 52. Other configurational factors are substantially the same as in the first embodiment.

The fueling nozzles 32 and 33 are each inserted in a downstream position relative to an entrance of the air hole 34 and entrances of the air holes 35 respectively. In the present embodiment, the number of air holes 35 is slightly greater than that of air holes 34, and thus an occupancy rate of a diffusive combustion region increases above that of a premixed combustion region. Therefore, a reduction effect against NOx emissions from a diffusive burner is likely to slightly decrease, whereas combustion stability is likely to improve over that obtainable in the first embodiment. Accordingly, flame stability can be maintained, even if the fuel is such a low-calorie fuel or slow-combustion fuel as heavily laden with nitrogen.

Although the number of air holes 35 in the present embodiment is slightly larger than that air holes 34, if the number of air holes 34 is increased above that of air holes 35, the occupancy rate of the premixed combustion region increases above that of the diffusive combustion region and the reduction effect against NOx emissions from the diffusive burner is likely to increase. Combustion stability is also likely to improve over that obtainable in the first embodiment. Irrespective of whether the number of either air holes 34 or air holes 35 is larger, since each air hole 34 and 35 has a rotation angle, heat and a chemical revitalization material are sufficiently supplied from a rotational flow in a downstream region of combustion and flame stability can therefore be maintained in the entire burner.

Eighth Embodiment

The burners in the first to seventh embodiments have each included two concentric air hole arrays. Fuel consumption and a flow rate of air significantly differ according to the type of object to which the burner is applied. For combustor and/or burner sizing-up accompanying with an increase in power-generating output, it is effective, as described in the above examples, to increase the number of fueling nozzles and that of air holes in the air hole member 31, not to adopt similar extension of the burner, in response to increases in the flow rates of air and fuel.

In addition, when the burner of the present invention is used as a pilot burner for the gas turbine combustor, using a kind of fuel may or will make it necessary that the flame formed by the pilot burner be enlarged to improve combustion stability of the flame.

Figure 10:
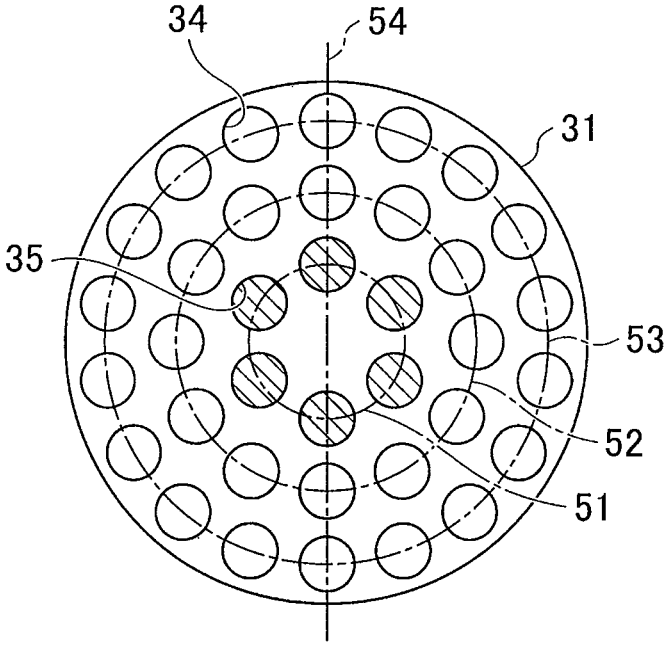
FIG. 10 is a front view, taken from a combustion chamber, of an air hole member formed in a burner equipped in an eighth embodiment of the present invention.

FIG. 10 is a front view, taken from a combustion chamber, of an air hole member formed in a burner equipped in an eighth embodiment of the present invention, this front view being keyed to FIG. 1B of the first embodiment.

In the present embodiment, the number of air hole arrays is increased from two in the first embodiment to three. The added outermost air hole array 53 includes air holes 54. As described above, the present embodiment is effective for forming larger flames particularly in a case where air and a fuel need to be supplied in greater quantities than in the first embodiment. The number of air hole arrays can also be further increased to four, depending upon the supply rates of air and fuel and upon a size of a flame to be formed.

In the present embodiment, among three air hole arrays from 51 to 53, only the innermost air hole array 51 is formed with air holes 35. All air holes in the air hole array 51 are the air holes 35. Each of the air holes 53 and 54 has a rotation angle. That is to say, although a diffusive combustion region formed in the combustion chamber 1 is substantially the same as in the first embodiment, since the addition of the air hole array 53 dimensionally extends a premixed combustion region, a rate of the diffusive combustion region to the entire flame becomes correspondingly smaller than in the first embodiment, so NOx emissions from the entire combustor are suppressed. When sizing up the burner in this way, combining the configuration for jetting the fuel from one fueling nozzle 33 towards the plurality of air holes 35 yields a great advantage in that an increase in the number of nozzles is suppressed.

Figure 11:
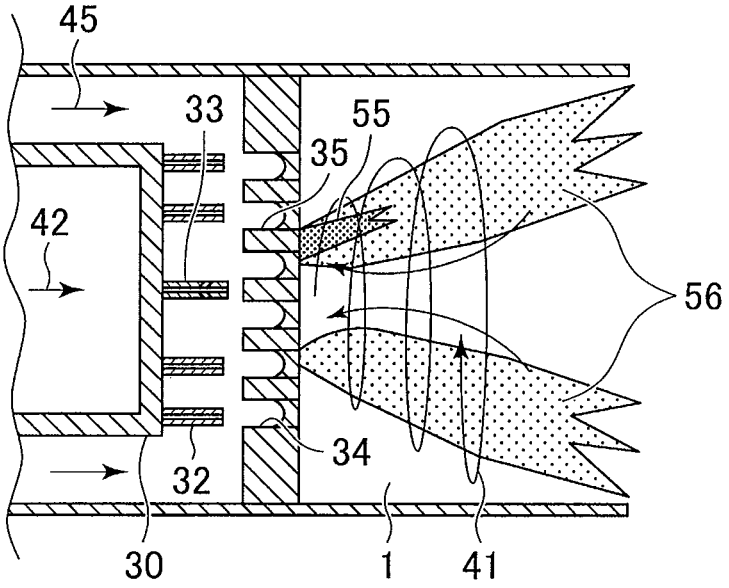
FIG. 11 is a schematic diagram of flames formed by the burner in the eighth embodiment of the present invention.

FIG. 11 is a schematic diagram of the flames formed by the burner of the present embodiment, this diagram also being a lateral sectional view taken along a central line 54 in FIG. 10.

As with the first embodiment, the present embodiment forms a diffusive combustion region at a downstream section relative to the air holes 35. While being supplied with both heat and a chemical revitalization material from the diffusive combustion region 55, a surrounding premixture expands towards a downstream side and a circumferential side, thus forming premixed flames 56. The air holes 35 in the inner air hole array 51 are paired with a fueling nozzle 33 having a distal end disposed at the downstream side relative to the entrance of the air hole, and diffusive combustion air is therefore jetted from the air hole 35. Additionally, in each air hole 34 of the air hole arrays 52 and 53, heat sufficient for the premixture can be supplied from the diffusive combustion region, and thus a premixed flame is stably retained at nearly an exit of each air hole 35 in the air hole array 51. Furthermore, since each air hole 35 in the innermost air hole array 51 has a rotation angle with respect to a central axis of the burner, the premixed flame 56 is formed downstream while expanding towards the circumferential side. The diffusive combustion region 55 present at a base of the premixed conical flame 56 expanding towards the downstream side retains the flame in the stable state. Even when the number of concentric air hole arrays is increased from two to three, combustion stability can be maintained without the diffusive combustion region 55 being dimensionally increased. Naturally, if all air holes 34 in the air hole arrays 52 and 53, except for the air holes in the innermost air hole array 51, have rotation angle as in the first embodiment, further combustion stability can be obtained interactively with effectiveness of the present invention.

Ninth Embodiment

As described in the eighth embodiment, the entire flame can be stably combusted by diffusively combusting a part of the flame base. When the burner of the present invention is used as a pilot burner, however, the burner is required to stably combust a flame under a wide range of operating conditions and would also be required to complement combustion stability by supplying heat to surrounding adjacent premixing burners and igniting each of these premixing burners to provide further combustion stability. In addition, if a material of a low calorie and a low combustion rate is used, unburnt hydrocarbons and/or carbon monoxide is usually liable to be discharged as a result of the premixed flame becoming extinguished midway and thus the fuel failing to completely react.

Figure 12:
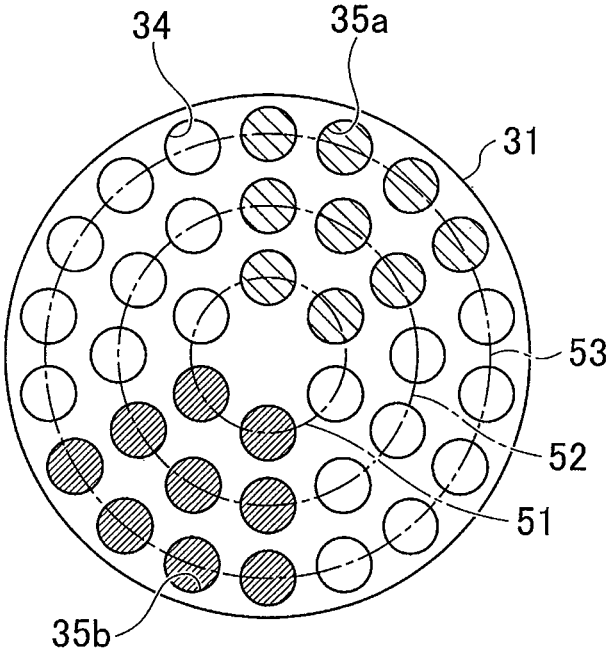
FIG. 12 is a front view, taken from a combustion chamber, of an air hole member formed in a burner equipped in a ninth embodiment of the present invention.

FIG. 12 is a front view, taken from a combustion chamber, of an air hole member formed in a burner equipped in a ninth embodiment of the present invention, this front view being keyed to FIG. 1B of the first embodiment.

In the ninth embodiment of FIG. 12, air holes 34 and 35 are mixedly present in three air hole arrays from 51 to 53. As with each above example, air holes 34 are each paired with a fueling nozzle 32, and air holes 35 are paired with a fueling nozzle 33, and similarly to the seventh embodiment, the air holes 35 are divided into groups 35*a* and 35*b* spanning all arrays. The groups 35*a* and 35*b* face each other with a central axis of the burner as their boundary, and are each formed into a fan-like shape by nine air holes 35 in which two holes are in an air hole array 51, three holes are in an air hole array 52, and four holes are in an air hole array 53. A fuel is jetted from one fueling nozzle 33 towards each air hole 35 of the groups 35*a* and 35*b*. In addition, two groups of air holes 34 are interposed between the groups 35*a* and 35*b*, and one of the two groups of air holes 34 is formed into a fan-like shape by nine air holes 34 in which one hole is in the air hole array 51, three holes are in the air hole array 52, and five holes are in the air hole array 53. Other configurational factors are substantially the same as in the first embodiment.

In the present embodiment, since the number of the air holes 34 is as same as that of the air holes 35, a premixed combustion region and a diffusive combustion region are likely to be nearly of the same occupancy rate. Accordingly, an NOx reduction effect in the entire combustor, compared with the reduction effect in each above example, is likely to decrease according to a particular increase in the occupancy rate of the diffusive combustion region. Combustion stability, however, improves. Adopting the above configuration with air holes 35 mixedly present in the outermost array as well, enables another diffusive combustion region to be formed at a position external to the flame formed in the burner, and thus, heat and a chemical revitalization material to be sufficiently supplied to an outer peripheral side of the flame. Therefore, even if the fuel is such a low-calorie and/or slow-combustion fuel as heavily laden with nitrogen, generation of unburnt hydrocarbons and/or carbon monoxide can be suppressed and flame stability maintained.

In addition, when the burner of the present embodiment is used as a pilot burner for the gas turbine combustor, combustion stability improves, which in turn extends a loaded-operation range of the gas turbine. When the number of pairs of fueling nozzle 33 and air holes 35 and the arrangements thereof are properly adjusted according to the kind of fuel to be used and operating conditions to be set, NOx emissions can be minimized in satisfying performance requirements relating to combustion stability.

Tenth Embodiment

While examples of adding air hole arrays to accommodate increases in the flow rates of the air and fuel supplied have been described as the examples of FIGS. 10 and 12, the number of air holes per array, for example, is not limited to the number described in these examples and can be increased as an alternative. Although the innermost air hole array 51 in each above example has included six air holes, this number can be increased to, for example, eight or ten. When the number of air holes in the innermost air hole array 51 is increased, that of air holes in each air hole array external to the innermost one will also be correspondingly increased and radial burner upsizing will be increasable.

Figure 13:
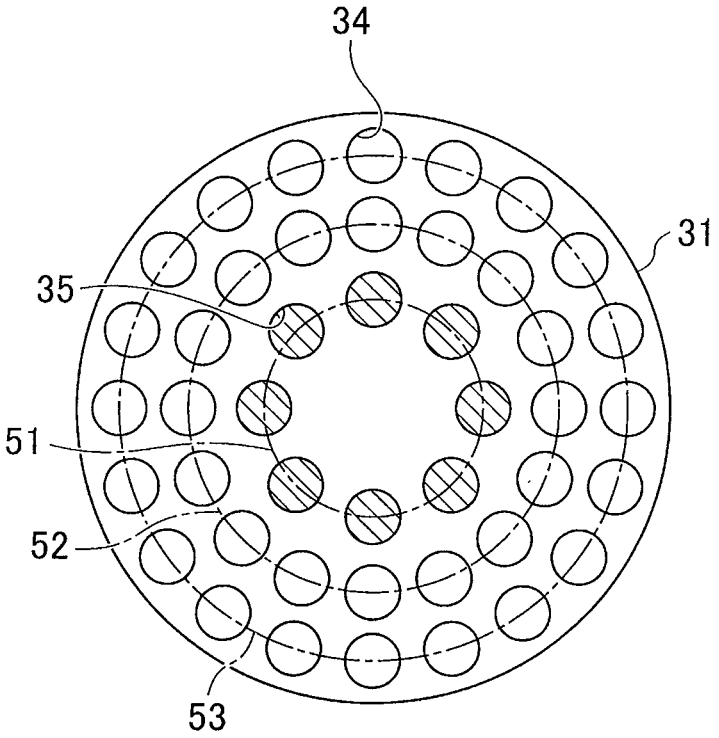
FIG. 13 is a front view, taken from a combustion chamber, of an air hole member formed in a burner equipped in a tenth embodiment of the present invention.

FIG. 13 is a front view, taken from a combustion chamber, of an air hole member formed in the burner equipped in the tenth embodiment of the present invention, this front view being keyed to FIG. 1B of the first embodiment.

As shown in FIG. 13, the innermost air hole array 51 in the present embodiment has eight air holes, the number of which is greater than that in each example described above. The air holes 35 paired with the fueling nozzle 33 are arranged in the innermost air hole array 51, as in the first embodiment, and the fuel is jetted from the same fueling nozzle 33, towards the eight air holes 35.

Eleventh Embodiment

Although the tenth embodiment has included three air hole arrays, there naturally is an advantage in changing the number of air holes per array, whether the number of air hole arrays be two or less or four or more.

Figure 14:
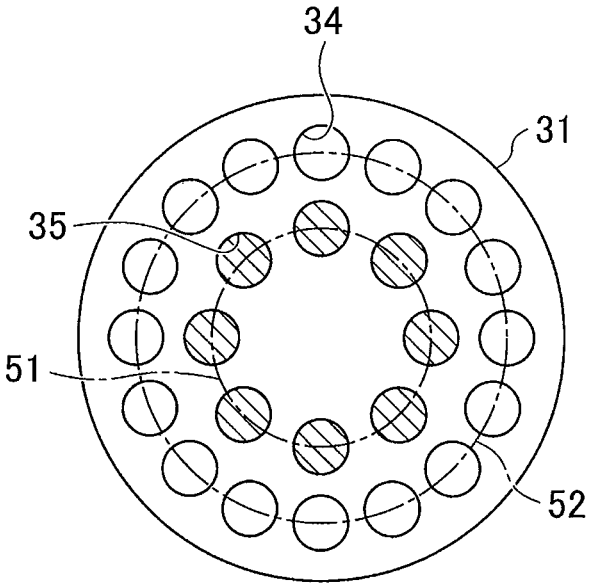
FIG. 14 is a front view, taken from a combustion chamber, of an air hole member formed in a burner equipped in an eleventh embodiment of the present invention.

FIG. 14 is a front view, taken from a combustion chamber, of an air hole member formed in a burner equipped in an eleventh embodiment of the present invention, this front view being keyed to FIG. 1B of the first embodiment.

In the present embodiment, the number of air holes in the innermost air hole array 51 is eight, as with the tenth embodiment. While the number of air holes per array is greater than that in up to the seventh embodiment, the number of air hole arrays is limited to two. Other configurational factors are substantially the same as in the tenth embodiment.

For example, even if increasing the number of air hole arrays oversizes the burner, the number of air holes in the entire burner can be increased while suppressing the oversizing of the burner, by maintaining an initial number of air hole arrays and increasing only the number of innermost air holes. In addition, since increasing the number of air holes per array expands the arrangement of these air holes as a whole outward, a circulation flow region formed at a downstream position centrally in the burner is also enlarged. Even an increase in the number of air holes 35 in the innermost air hole array 51, therefore, supplying a fuel from one fueling nozzle 33 to the air holes 35 is possible, and thus maintaining combustion stability is possible while suppressing a quantitative increase of fueling nozzles.

Twelfth Embodiment

Figure 15:
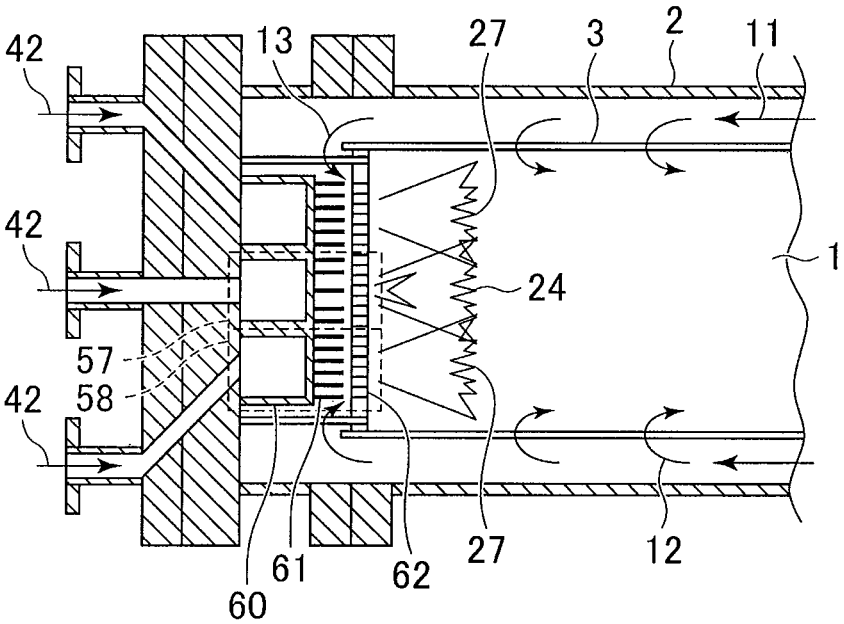
FIG. 15 is a lateral sectional view of a gas turbine combustor according to a twelfth embodiment of the present invention.
Figure 16:
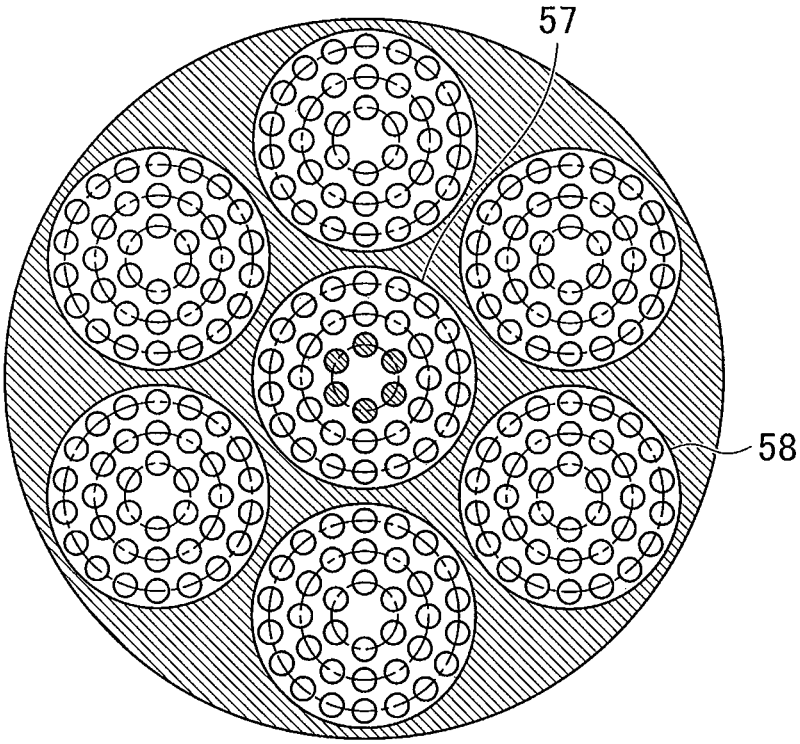
FIG. 16 is a front view, taken from a combustion chamber, of an air hole member formed in a burner equipped in the twelfth embodiment of the present invention.

FIG. 15 is a lateral, sectional view of a gas turbine combustor according to a twelfth embodiment of the present invention, and FIG. 16 is a front view, taken from a combustion chamber, of an air hole member formed in a burner equipped in the twelfth embodiment of the present invention, this front view being keyed to FIG. 1B of the first embodiment.

The gas turbine combustor according to the present embodiment includes a plurality of burners each having an air hole member, at an upstream side of the combustion chamber 1, and the present invention (e.g., any one of the first to eleventh embodiments) is applied to a burner 57 provided centrally in the combustor. The burner 57 has a plurality of (in the present embodiment, six) burners 58 arranged at its outer peripheral side. Each burner 58 includes a fuel header 60, fueling nozzles 61, and air holes 62, and fuel jet flows supplied to each of these elements can each be independently controlled. The plurality of air holes 62 are provided in the air hole member, and the same number of fueling nozzles 61 as the air holes 62 are arranged in association with each air hole 62. In each burner 58, the fuel that has been sent to the fuel header 60 is distributed to the fueling nozzles 61 connected to the fuel header 60, and after being injected from each fueling nozzle 61 towards each of the associated air holes 62, the fuel is premixed with air during passage through the air holes 62 and then jetted into the combustion chamber 1.

In each outer burner 58, all fueling nozzles have respective distal ends arranged at an upstream side relative to an entrance of each air hole. This arrangement forms an airflow at an outer peripheral side of the fuel flow in the air hole, thus premixing the fuel and the air. At this time, since an internal volume of the air hole is small in comparison with that of the combustion chamber 1, the fuel and the air can be sufficiently mixed at a short distance and a premixed flame 27 is formed at a downstream section of the burner 58.

Gas turbines need to be operated under a wide range of conditions from starting conditions to rated-load conditions. In particular, under the starting conditions and under new conditions established after fuel system switching, since fuel-air ratios decrease locally in the burner, it is very important to maintain combustion stability of flames. Applying the present invention to the central burner 57 in the combustor improves combustion stability of the burner 57, thus making high reliability obtainable according to particular speed-increasing conditions of the gas turbine, even from the start of its operation. The premixed flame 27 formed at a downstream side of each outer burner 58 is also supplied with heat and a chemical revitalization material from a flame 24 formed at a downstream side of the central burner 57. Combustion stability can therefore be maintained while suppressing an increase in the number of fueling nozzles.

Thirteenth Embodiment

Figure 17:
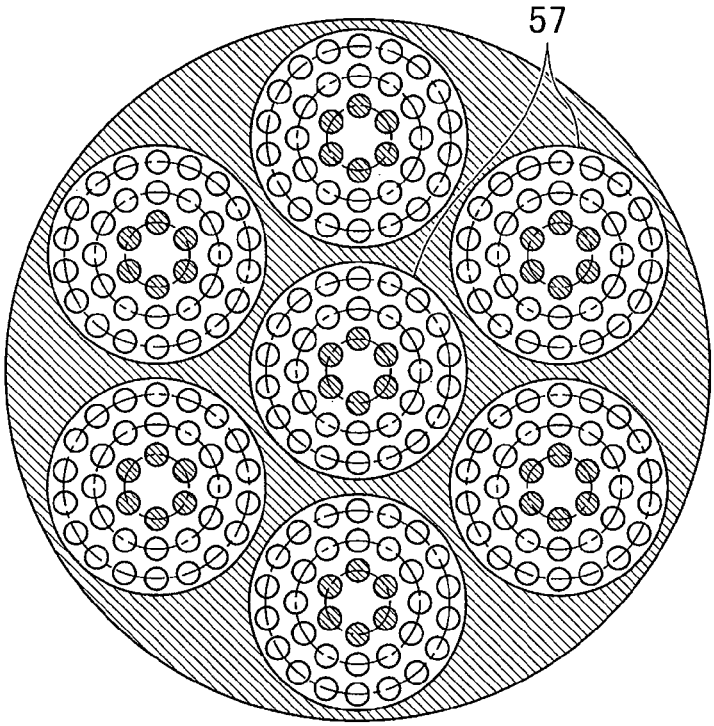
FIG. 17 is a front view, taken from a combustion chamber, of an air hole member formed in a burner equipped in a thirteenth embodiment of the present invention.

FIG. 17 is a front view, taken from a combustion chamber, of an air hole member formed in a burner equipped in a thirteenth embodiment of the present invention, this front view being keyed to FIG. 1B of the first embodiment.

In the present embodiment, burners 57 applying the present invention are arranged instead of the outer burners in the twelfth embodiment. In the present embodiment, since a diffusive combustion region is present for the flames formed by the individual burners 57, NOx emissions are therefore likely to increase, but the flames formed by each burner 57 improve in combustion stability. Accordingly, even if a low-calorie fuel or any other fuel that is low in combustion rate and highly flame-retardant is used as a fuel for the gas turbine, a diffusive combustion region will be formed at bases of the flames formed by the plurality of burners 57. Flame stability can therefore be retained and high operational reliability obtained. The gas turbine can also have its loaded operating range extendible at the same time.

Fourteenth Embodiment

Figure 18:
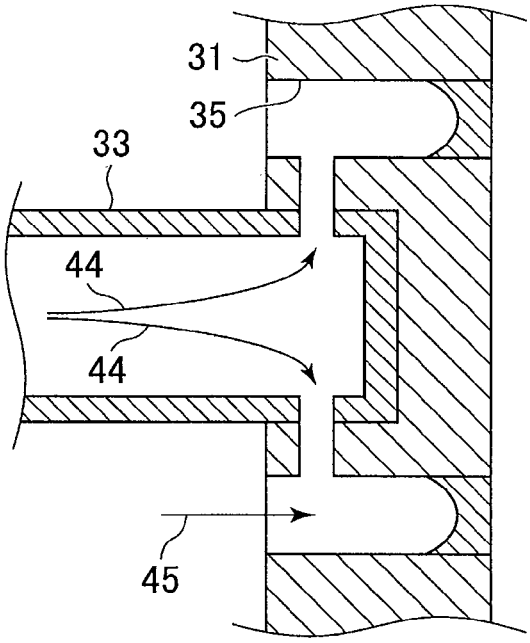
FIG. 18 is a lateral sectional view showing a schematic structure of a fueling nozzle equipped in a burner according to a fourteenth embodiment of the present invention.

FIG. 18 is a lateral sectional view showing a schematic structure of a fueling nozzle 33 equipped in a burner according to a fourteenth embodiment of the present invention.

Unlike the fueling nozzle 33 in the first embodiment, the fueling nozzle 33 of the burner in FIG. 18 has a distal end disposed at a downstream position relative to entrances of air holes 35, and the distal end is inserted centrally in an air hole member 31. On a circumferential surface of the fueling nozzle 33 are perforated a plurality of injection ports each of which directly communicates with a lateral side of each air hole 35 in the innermost air hole array 51, via respective pass-through pores. The pass-through pores radially extend from a central portion of the air hole member 31, penetrating to plate thickness thereof. The air holes 35 are provided with a rotational angle for circumferential inclination to a central axis of the burner, as in other examples including the first embodiment. Other structural factors of the burner are substantially the same as in the above-described examples.

In the present embodiment, a fuel jet flow 44 jetted from the fueling nozzle 33 collides against an inner wall surface of each air hole 35 and flows into a downstream side along the inner wall surface of the air hole 35. Compared with a combination of a fueling nozzle 32 and air holes 34, therefore, the amount of air flowing into the air hole 35 increases in a relative fashion and the fuel jet flow 44 is jetted into a combustion chamber 1 without making no progress in mixing with air 45. Direct fuel jetting by the fueling nozzle 33 into the air hole 35 through the inside of the air hole member 31 makes mixing between the fuel jet flow 44 and the air 45 more efficiently suppressible, because of no obstruction disturbing the flow of the air 45 into the air hole 35.

What is claimed is:

1. A burner comprising:

an air hole member with a plurality of air holes, said plurality of air holes including a plurality of first air holes and a plurality of second air holes that are different from the plurality of first air holes, all of said plurality of air holes being located in the air hole member at an upstream side of post-combustion gases which are generated in a combustion chamber;

at least one first cylindrical fueling nozzle for jetting a fuel from a plurality of injection ports provided on an outer circumferential surface of the at least one first cylindrical fueling nozzle and which fuel jetted from said plurality of injection ports is directed only towards inner wall surfaces of at least two adjacent ones of the plurality of first air holes;

a plurality of second fueling nozzles, each second fuel nozzle being provided in association with each one of the plurality of second air holes that are different from the plurality of first air holes, each of the second fueling nozzles being formed for jetting the fuel in a direction routed along a burner axis and only towards an associated one of the plurality of second air holes that are different from the plurality of first air holes;

a fuel header for distributing the fuel to the at least one first cylindrical fueling nozzle and to each of the second fueling nozzles; and a fuel header storage unit that shrouds the fuel header, the at least one first cylindrical fueling nozzle and each of the plurality of second fueling nozzles, the fuel header storage unit including an air inflow hole.

2. The burner according to claim 1, wherein the plurality of air holes are arranged in a plurality of concentric air hole arrays including an innermost air hole array containing said plurality of first air holes, each of the plurality of air holes being inclined in a circumferential direction with respect to the burner axis, wherein the at least one first cylindrical fueling nozzle is disposed on a central axis of the air hole member, the at least one first cylindrical fueling nozzle being formed for jetting the fuel only towards an inner wall surface of two adjacent ones of the plurality of first air holes located in the innermost air hole array, and wherein each of the second fueling nozzles is provided at a position opposed to the center of an entrance to one of the associated one of the plurality of second air holes in an axial direction of the burner, each of the second fueling nozzles being formed for jetting the fuel towards only its associated one of the plurality of second air holes and excluding each of the plurality of first air holes in the innermost air hole array.

3. The burner according to claim 1, wherein the plurality of air holes are arranged in a plurality of concentric air hole arrays, each of the plurality of air holes being inclined in a circumferential direction with respect to the burner axis, wherein the plurality of air holes in an innermost one of the plurality of air hole arrays are divided into a first group of air holes and a second group of air holes such that the at least one first cylindrical fueling nozzle jets the fuel only towards the inner wall surfaces of one of the plurality of air holes in the first group of air holes and one of the plurality of air holes in the second group of the air holes in the innermost one of the plurality of air hole arrays, and wherein each of the plurality of second fueling nozzles is provided at a position opposed to the center of an entrance of one of the associated plurality of air holes in an axial direction of the burner, each second fueling nozzle being formed for jetting the fuel towards its one of the plurality of second air holes and excluding the plurality of air holes in the innermost one of the plurality of air hole arrays.

4. The burner according to claim 3, wherein each air hole in the first group of air holes in the innermost one of the plurality of air hole arrays is adjacent an air hole in the second group of air holes in the innermost one of the plurality of air hole arrays.

5. The burner according to claim 3, wherein the first group of air holes in the innermost one of the plurality of air hole arrays and the second group of air holes in the innermost one of the plurality of air hole arrays are alternatingly disposed on a circumference defined by the innermost one of the plurality of air hole arrays.

6. The burner according to claim 1, wherein each of the at least one first fueling nozzle and the plurality of second fueling nozzles have a distal end positioned at an upstream side relative to an entrance of an associated one of the plurality of air holes.

7. A combustor comprising:

a pilot burner including:

an air hole member with a plurality of air holes, said plurality of air holes including a plurality of first air holes and a plurality of second air holes that are different from the plurality of first air holes, all of said plurality of air holes being located in the air hole member at an upstream side of post-combustion gases which are generated in a combustion chamber;

at least one first cylindrical fueling nozzle for jetting a fuel from a plurality of injection ports provided on an outer circumferential surface of the at least one first cylindrical fueling nozzle and which fuel jetted from said plurality of injection ports is directed only towards inner wall surfaces of at least two adjacent ones of the plurality of first air holes;

a plurality of second fueling nozzles, each second fuel nozzle being provided in association with each one of the plurality of second air holes that are different from the plurality of first air holes, each of the second fueling nozzles being formed for jetting the fuel in a direction routed along a burner axis and only towards an associated one of the plurality of second air holes that are different from the plurality of first air holes;

a fuel header for distributing the fuel to the at least one first cylindrical fueling nozzle and to each of the second fueling nozzles; and a fuel header storage unit that shrouds the fuel header, the at least one first cylindrical fueling nozzle and each of the plurality of second fueling nozzles, the fuel header storage unit including an air inflow hole;

said pilot burner being disposed at an upstream side of a combustor liner in a flow direction of post-combustion gases; and a premixing burner provided at an outer peripheral side of the pilot burner, the premixing burner being inclusive of a premixing channel for mixing the fuel and air, and of a flame stabilizer provided at an exit of the premixing channel.

8. A combustor comprising:

a pilot burner including:

an air hole member with a plurality of air holes, said plurality of air holes including a plurality of first air holes and a plurality of second air holes that are different from the plurality of first air holes, all of said plurality of air holes being located in the air hole member at an upstream side of post-combustion gases which are generated in a combustion chamber;

at least one first cylindrical fueling nozzle for jetting a fuel from a plurality of injection ports provided on an outer circumferential surface of the at least one first cylindrical fueling nozzle and which fuel jetted from said plurality of injection ports is directed only towards inner wall surfaces of at least two adjacent ones of the plurality of first air holes;

a plurality of second fueling nozzles, each second fuel nozzle being provided in association with each one of the plurality of second air holes that are different from the plurality of first air holes, each of the second fueling nozzles being formed for jetting the fuel in a direction routed along a burner axis and only towards an associated one of the plurality of second air holes that are different from the plurality of first air holes;

a fuel header for distributing the fuel to the at least one first cylindrical fueling nozzle and to each of the second fueling nozzles; and a fuel header storage unit that shrouds the fuel header, the at least one first cylindrical fueling nozzle and each of the plurality of second fueling nozzles, the fuel header storage unit including an air inflow hole;

said pilot burner being disposed at an upstream side of a combustor liner in a flow direction of post-combustion gases; and a plurality of outer burners each provided at an outer peripheral side of the pilot burner, each of the plurality of outer burners being inclusive of an air hole member having a plurality of air holes, and of fueling nozzles equal in number to the plurality of air holes, and each outer burner being further adapted to jet the fuel from each of the fueling nozzles via associated air holes towards the combustion chamber.

9. A combustor comprising:

a plurality of pilot burners each including:

an air hole member with a plurality of air holes, said plurality of air holes including a plurality of first air holes and a plurality of second air holes that are different from the plurality of first air holes, all of said plurality of air holes being located in the air hole member at an upstream side of post-combustion gases which are generated in a combustion chamber;

at least one first cylindrical fueling nozzle for jetting a fuel from a plurality of injection ports provided on an outer circumferential surface of the at least one first cylindrical fueling nozzle and which fuel jetted from said plurality of injection ports is directed only towards inner wall surfaces of at least two adjacent ones of the plurality of first air holes;

a plurality of second fueling nozzles, each second fuel nozzle being provided m association with each one of the plurality of second air holes that are different from the plurality of first air holes, each of the second fueling nozzles being formed for jetting the fuel in a direction routed along a burner axis and only towards an associated one of the plurality of second air holes that are different from the plurality of first air holes;

a fuel header for distributing the fuel to the at least one first cylindrical fueling nozzle and to each of the second fueling nozzles; and a fuel header storage unit that shrouds the fuel header, the at least one first cylindrical fueling nozzle and each of the plurality of second fueling nozzles, the fuel header storage unit including an air inflow hole:

each of said pilot burners being disposed at an upstream side of a combustor liner in a flow direction of post-combustion gases.

* * * * *